US006810864B1

(12) United States Patent
Folk

(10) Patent No.: US 6,810,864 B1
(45) Date of Patent: Nov. 2, 2004

(54) FUEL CONDITIONER

(76) Inventor: Donald C. Folk, 10415 Folson Blvd., Rancho Cordova, CA (US) 95670

( * ) Notice: Subject to any disclaimer, the term of this patent is extended or adjusted under 35 U.S.C. 154(b) by 0 days.

(21) Appl. No.: 10/687,779

(22) Filed: Oct. 15, 2003

(51) Int. Cl.[7] ..... F02M 27/02
(52) U.S. Cl. ..... 123/538
(58) Field of Search ..... 123/536, 537, 123/538

(56) References Cited

U.S. PATENT DOCUMENTS 4,429,665 A * 2/1984 Brown ..... 123/3
5,013,450 A * 5/1991 Gomez ..... 210/687
5,249,552 A * 10/1993 Brooks ..... 123/1 A
5,305,725 A * 4/1994 Marlow ..... 123/538
5,378,358 A * 1/1995 Park ..... 210/187
5,533,490 A * 7/1996 Pascall ..... 123/538
5,738,692 A * 4/1998 Wright ..... 44/321
5,871,000 A * 2/1999 Ratner ..... 123/538
6,000,381 A * 12/1999 Berlin et al. ..... 123/538
6,361,689 B1 * 3/2002 Munzing ..... 210/222

* cited by examiner

*Primary Examiner*—Marguerite McMahon
(74) *Attorney, Agent, or Firm*—Mark C. Jacobs

(57) ABSTRACT

A fuel conditioning device designed for interposition between an engine's fuel supply line and the engine's fuel combustion zone, which device has a cylindrical body portion, with an input end and an output end, and a flow through passageway in the body portion. The input end is in fluid communication with the fuel supply line, and the output end is in fluid communication with the fuel combustion portion of the engine. Disposed within the body portion is a series of only plastic disks at each end that move the incoming and outgoing fuel in a quasi-sinusoidal pattern, and such movement of fuel is also carried out through a series of cells formed of a pair of plastic spaced and opposed disks with a copper-based disk in intimate contact with a zinc-based disk between each such pair of opposed spaced disks, between the series of only plastic disks.

20 Claims, 7 Drawing Sheets

FUEL CONDITIONER

FIELD OF THE INVENTION

This invention pertains to a device for increasing the efficiency of fossil fueled internal combustion engines and for reducing the pollution by-products of the burning of such fuels.

BACKGROUND OF THE INVENTION

It is well known that internal combustion engines are quite inefficient. Internal combustion engines, which burn fossil fuels, and typically emit under burned or unburned fuel from the exhaust of the vehicle as well as undesirable byproducts of combustion which include not only particulates, but noxious gases such as carbon monoxide and various nitrogen oxides, among others. The under burning of fuel causes environmental problems such as smog and the inability of many people to breathe under certain weather conditions. Indeed, some of the pollutants are thought to be cancer causing.

Not only do some of these unburned portions of the fossil fuel accumulate in the atmosphere many of them tend to accumulate directly in the internal combustion engine. No doubt, we have all heard of engine additives to clean spark plugs to improve efficiency to prevent rust, etc., these products are sold due to the incomplete burning of fossil fuel, be it gasoline or diesel fuel. These accumulations within the vehicle engine can cause the various engine components to wear out sooner and to be the subject of more frequent maintenance and repairs. Therefore, there has been a long felt need for a means to increase the efficiency of fossil fuel internal combustion engines.

Over the years, there have been numerous fuel conditioning devices and apparatuses patented and marketed in an ongoing effort to alleviate some of the problems discussed above. Some of these apparatuses raise the temperature of the fuel thus increases its propensity to burn more easily. With the benefit derived from the super heating of the fuel there are also detriments such as the higher sustained engine temperatures which could prove detrimental to the desired long term usage of the vehicle engine.

Another approach is to add minute quantities of certain chemicals to the fuel mixture, in the hope that solid particles in additives will dissolve in the fuel and/or be consumed. There is of course the danger of a detrimental effect of the corroding of metal parts due to the presence of some these chemical additives.

Still, other inventors have felt to introduce the fuel to a potential chemical reaction with certain chemical elements or chemical compounds to modify the properties of the fuel prior to the fuel reaching the fuel chamber. Again, such approaches have not been overly successful in that the cost benefit acquired to procure such devices has not paid big enough dividends in increased miles per gallon operation of the vehicle to justify the pricing of the device.

Among the patents of which applicant has become familiar are the following:

| Inventor | Patent # | Issued | Features |
|---|---|---|---|
| RATNER | 5,871,000 | 2/16/99 | CU, AL, stainless steel disposed in mesh "basket" |
| WRIGHT | 5,738,692 | 4/14/98 | Mixture of at least 1 of Sb, Sn, Pb, and Hg |

-continued

| Inventor | Patent # | Issued | Features |
|---|---|---|---|
| MARLOW | 5,305,725 | 4/26/94 | Cones and bands of silver or silver alloy coated over brass, copper and/or bronze, Zn, MG, or Mn |
| BERIN et al | 6,000,381 | 12/14/99 | Hydrides of metals |
| BROWN | 4,429,665 | 2/7/84 | metal bar of Ni, Zn, Cu, Sn, and Ag |
| GOMEZ | 5,013,450 | 5/7/91 | Alloy of Au, Zn, Ni, Al, Mn, and Sn |

It is seen therefore that since at least as early as 1991, inventors have been putting metals of varying sizes, shapes, and formats, alloyed and pure, into containers having flow through passageways for fuel to contact these metallic forms.

Many other fuel conditioner patents can be found in the prior art. Many of these require engine modification or the use of additives to the fuel. Both of these options are unacceptable to most vehicle owners.

The need for a fuel modifier that increases MPG and reduces emission particulates in noxious gases still exists. This invention meets those needs.

SUMMARY OF THE INVENTION

A fuel conditioner device having an input end to receive fuel, a flow through passageway in a tubular body portion for the disposition of a plurality of plastic and metal disks of a specific configuration to create a quasi sinusoidal flow of the fuel through the disks disposed in the passageway. The fuel flows out an outlet end of the body portion, which outlet end is in fluid communication with the combustion chambers of the engine. The flow through passageway is located in a cylindrical body portion having the inlet end and the outlet end in line with the passageway.

It is an object therefore to provide a device for the conditioning of fuel to improve mpg and to reduce particulate and noxious gas emissions from a vehicle internal combustion engine.

It is a second object to provide a device having an inlet end, a cylindrical body and an outlet wherein a plurality of specifically configured disks are disposed in the body portion for the fuel to pass through on its travel from the body portion via the outlet portion, which is an outlet plug, to the combustion area of the engine.

It is a third object to provide a fuel conditioner wherein plastic, copper alloy, and zinc disks of a specific configuration are disposed in the body portion of the device.

It is a fourth object to provide a fuel conditioner that works with both gasoline and diesel fuels to improve mpg and provide a reduction of emissions without any modification to the engine.

Other objects of the invention will in part be obvious and will in part appear hereinafter.

The invention accordingly comprises the device possessing the features properties and the relation of components disclosed herein, all of which are exemplified in the following detailed disclosure and the scope of the application of which will be indicated in the appended claims.

For a fuller understanding of the nature and objects of the invention reference should be made to the following detailed description, taken in conjunction with the accompanying drawings.

DESCRIPTION OF THE PREFERRED EMBODIMENT

Figure 1:
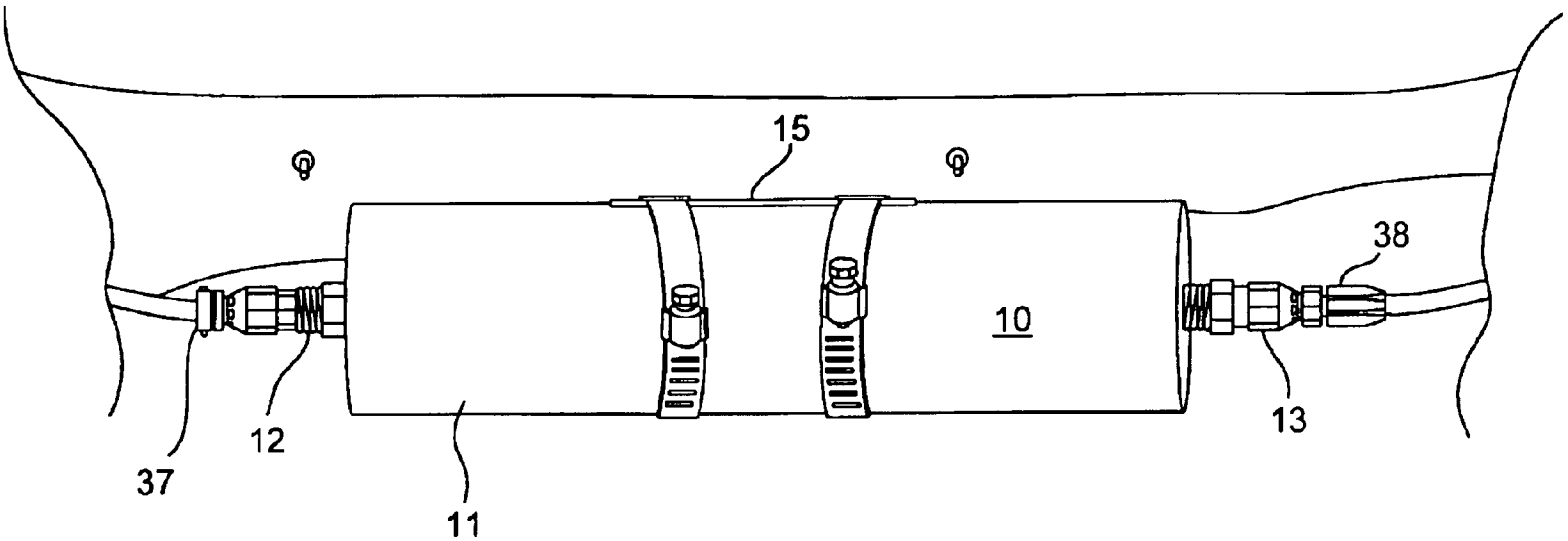
FIG. 1 is a perspective view of the device of this invention installed under the hood of a car.

In FIG. 1 there is shown the device 10 of this invention. The device is seen to be installed by a mount bracket 12 to a metal member in the engine compartment of the car. Device 10 has an input 12, in fluid communication with the fuel line, be it diesel or gasoline. This input is also in fluid communication with the main body 11 of this fuel conditioning device. Disposed in line with the input is an output 13 in fluid communication with the flow through passageway of the main body 11, which passageway is not seen in FIG. 1. The output is in fluid communication with the combustion chamber of the vehicle, not seen and not forming any part of this invention. Note the presence of connector members 37,38 which lead to the fuel supply line from 37, and to the combustion chamber for connector 38.

Figure 2:
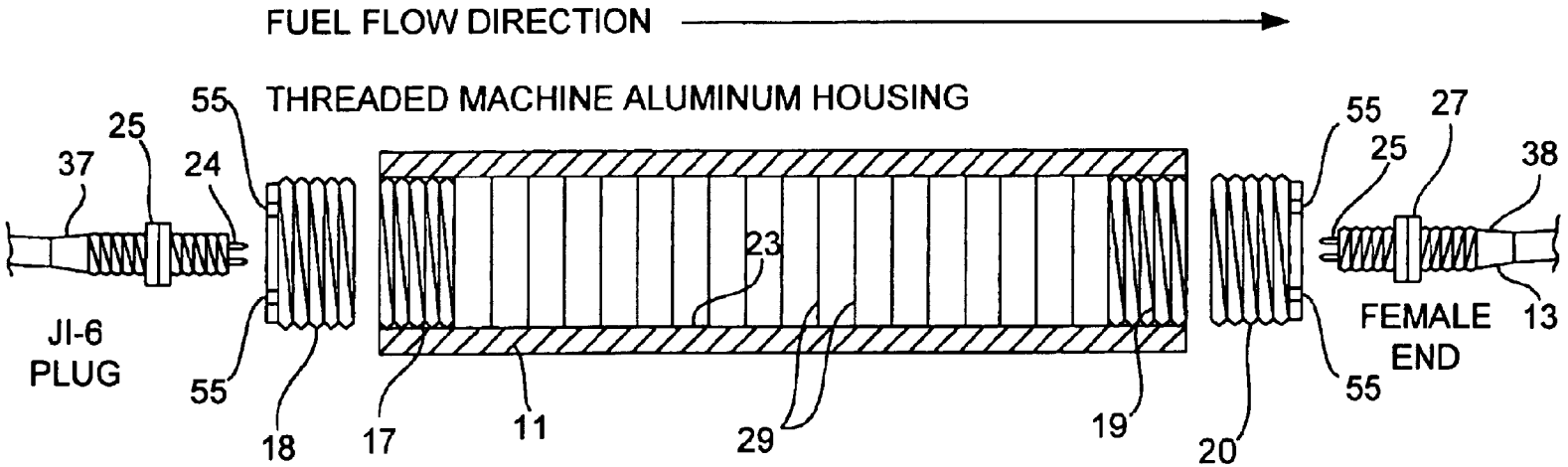
FIG. 2 is a sectional view of the housing and other parts of this device.
Figure 3:
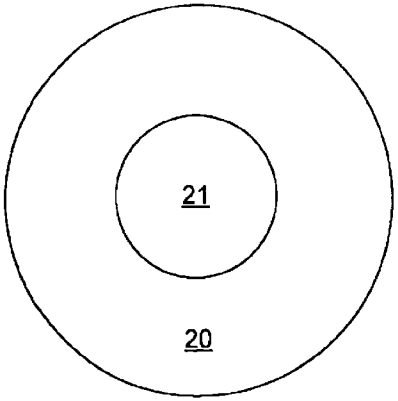
FIG. 3 is an end elevational view of the housing.

In FIG. 2, a closeup sectional view of the portions of the invention is shown. Here the main body portion 11 is seen to be a cylinder having internally threaded opposed open ends 17,19. Each end 17 and 19 is closed off by a respective threaded cap 18,20. Both caps are of the same configuration, namely, annular one of which 20 is seen in end view in FIG. 3. The end 20 has a center internally threaded opening 21. A similar opening 22 is found in cap 18. The input plug and output plug, 12, 13 are the same, and respectively thread into the threaded openings 21,22 of the end caps. These threaded plugs each have a central passageway 24,26 respectively that communicate with the fuel line on the intake side and the combustion chamber on the output or exit side. A hexnut 25,27 is disposed on each of the plugs for tightening the connection the respective fuel line and combustion chamber input sides to the respective end plugs to the point of applying a pressure on the contents of the passageway of the body portion 11. In this view, 29 designates the interior of body 11, where the pluralities of disks are to be placed as will be discussed below.

Figure 4:
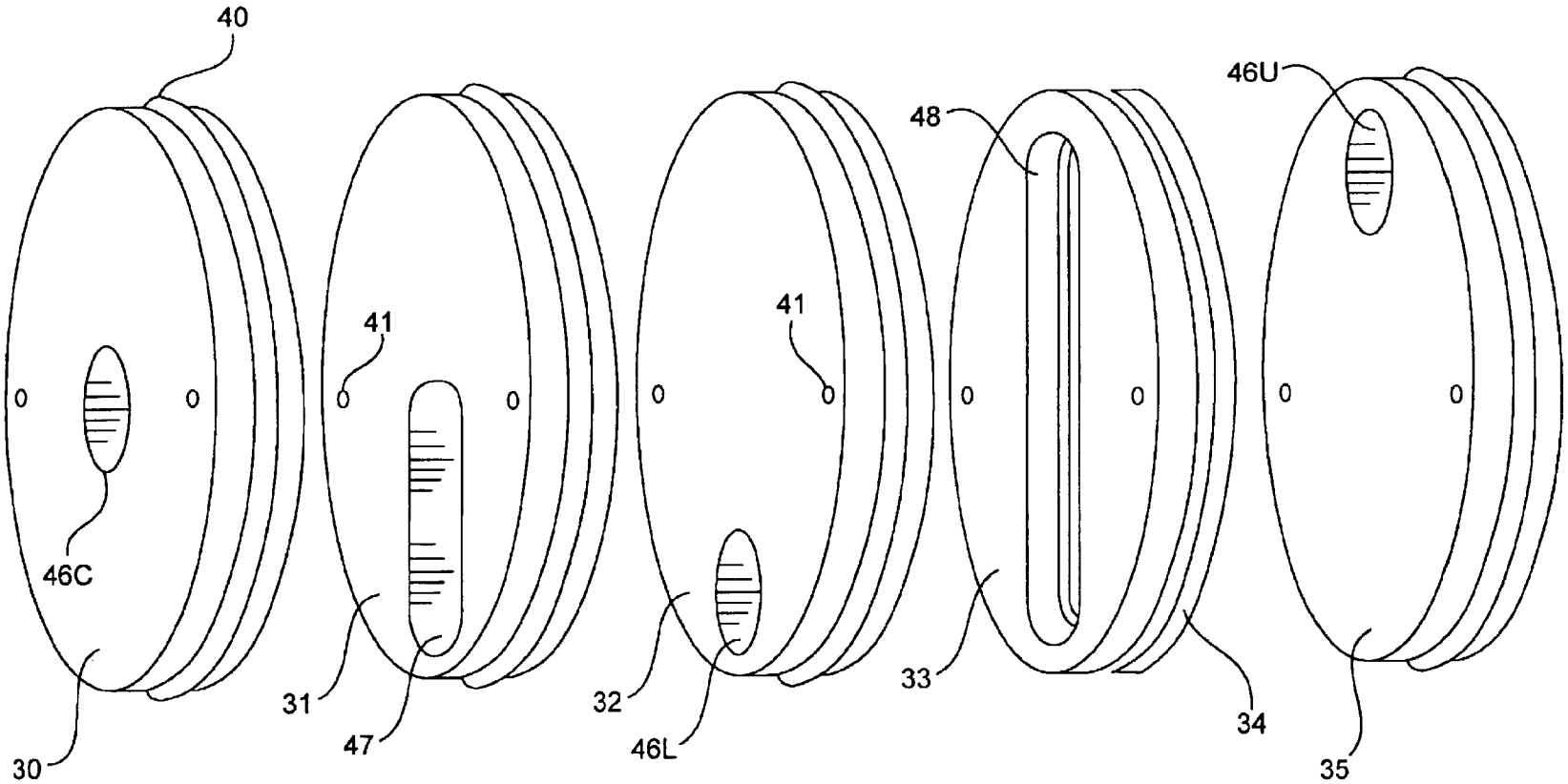
FIG. 4 is perspective view of a plurality of the elements found in the housing of this device.

The discussion moves to FIG. 4. Here the various disks are seen magnified and spaced from each other. There are two types of disks, plastic ones, used as insulators, and the metallic ones.

Disposed within the body portion is a first series of only plastic disks at the input end that move the incoming and outgoing fuel in a quasi-sinusoidal pattern; a second series of only plastic disks that move the outgoing fuel in a quasi-sinusoidal pattern and such quasi-sinusoidal movement of fuel is also carried out through a series of cells each formed of one face of a pair of plastic spaced and opposed disks with a copper-based disk in intimate contact with a zinc-based disk between each such pair of opposed spaced disks, which series of cells is disposed in line between the two series of only plastic disks. Note carefully that the plastic disk that has its right facing face forming part of the first cell, and the plastic disk having its left facing face forming part of the last cell, is counted twice. The respective faces form part of a cell as that term is defined as a volume of space bounded by disk walls. The entire disk forms a part of the series of only plastic disks, i.e., structure. Using this counting method, it is seen that in FIG. 8 there are nine cells, and each only plastic series of disks has three disks.

All plastic disks are the same and have a diameter substantially equal to the diameter of the interior 29 of the main body 11. Within the category of plastic disks, there is a plurality of variants. See FIGS. 4 and 10.

Figure 5:
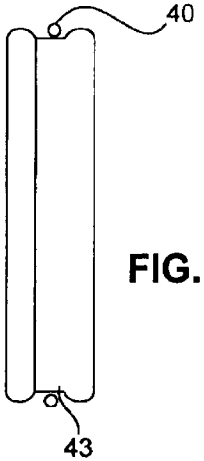
FIG. 5 is a closeup end view of one of the disks used in this invention.
Figure 10:
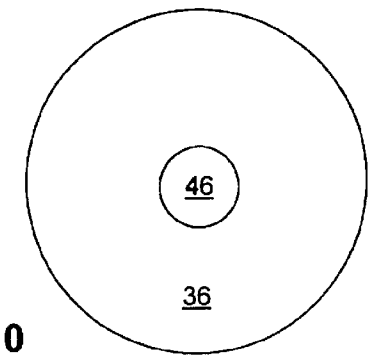
FIG. 10 is an elevational view of an optional terminal disk that can be used in this invention.

The disk of FIG. 10 is discussed first, as this is an optional disk 36, that would be placed in abutment on the interior side of an end cap. Note that there are no rod apertures, only a central opening 46 for these two disks. They may be used to retain the rods in position during assembly of the device. Returning now to FIG. 4, the disks are shown in inverse order. That is, disk 34 is the copper-based disk, while disk 33 is a zinc-based disk and the copper disk is preferably placed in the first direction of the incoming fluid flow. Each other than 33,34 is of plastic such as nylon or Delrin™ and should have insulative properties. Each disk has a groove 43 at the midpoint along the thickness thereof as is seen in FIG. 5. Disposed in each groove 43 is an O-ring 40 to ensure a tight seal against the interior wall 23 of the body portion.

Returning now to FIG. 4, in which the direction of fluid flow is from right to left, it is seen that plastic disk 30 has a round central bore 46C. Whereas disk 31 has a half racetrack slot 47 that runs from the center of the disk toward the lower positioned end thereof, which is about ½ of the disk face while the other half of the disk face is left blank. Disk 32 has a lower disposed round opening 46L. Next comes a zinc disk with a full racetrack opening, 48, that runs from the center toward the opposed edges of the disk adjacent and in intimate contact with a copper-based disk 34 that also has a full size racetrack slot 48 not visible in this view, but aligned with the slot of disk 33. This is followed by a disk 35 having a round bore 46U but at the upper position.

It is to be noted that neither of the metal disks has a central edge groove and that the diameter of the metallic disks are less than the diameter of the plastic disks. This last is true for two reasons. Firstly, to ensure no contact of the metal disks with the wall 23 to avoid possible static charges and second to permit fluid flow only through the aligned racetrack slots of the Cu and Zn based metal disks, and not around the pair of metal disks in intimate contact. This is because the fluid can only move in the plastic disks in the racetrack slots and apertures and it is only these that are in fluid communication with the racetrack slots of the metal disks in the cells.

Previously I have indicated that each plastic disk has an O-ring 40 in groove 43. While such is preferred, it is believed that the O-ring need only be present in the plastic disks at each end of the rodded disks. While the failure to require O-rings might permit some fuel to escape between plastic disks, such that some fuel flows over the top of the cell members as well as through the cell members, when assembled and the input and output plugs are tightened, with a spanner wrench in spaced recesses 55 in plugs 18,20 per FIG. 2, this will not occur. Hexnut, 25 on plug 12 and nut 27 on the other plug 13, when tightened apply a pressure on the hose connection from the respective fuel supply and the combustion chamber intake line.

All disks have a pair of spaced rod bores 41, through which are placed nylon or other suitable plastic rods 42 of less than 0.25 inch in diameter to retain the disks in a vertical position within the confines 29 of the cylinder 11. See FIG. 8 where the rods 42 are shown disposed in rod bores 41. All of the rod bores are located at the same location on each disk, be it metallic or plastic in order to keep the various disks in alignment such that the quasi-sinusoidal flow described herein can transpire. If the disks were not in alignment as desired, the fuel could not flow from one end of the device to the other end.

Figure 6:
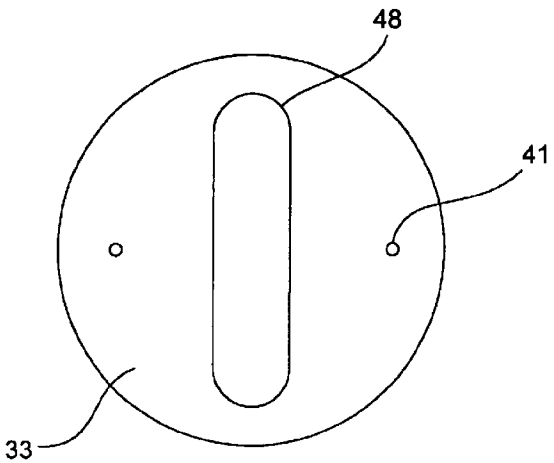
FIG. 6 is a front elevational view of one of the two metallic disks used in this invention.
Figure 7:
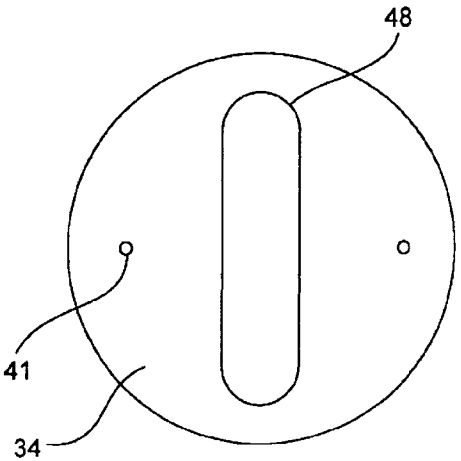
FIG. 7 is a view similar to FIG. 6 but of the second metallic disk.

FIGS. 6 and 7 depict the end views of the two metal disks 33 and 34. Both disks have the rod apertures 41 and a full racetrack slot 48. A full racetrack slot extends an equal amount in two directions from the diameter of the disk. A half racetrack slot only extends from the diameter toward one end. Note also that the thickness of each metal disk is substantially equal to the thickness of a plastic disk In FIG. 8 the directional arrow 50 depicts the direction of fluid flow. Thus the copper-based disk 34 is shown to the right and the zinc-based disk 33 is shown leftwardly. This view illustrates the placement of the plurality of disks laterally, for disposition within the confines 23 of the body portion 11. Note however that for the purpose of illustration spacing is seen between adjacent disks, whereas in reality all disks touch each other when stacked within the body portion 11 and the pressure from the nuts 25,27 on the opposite end caps are applied.

It has been found that the results differ when the zinc-based disk comes in first contact with the fuel. Therefore, the copper disk of each cell should face the incoming fuel.

Sizing

Figure 9:
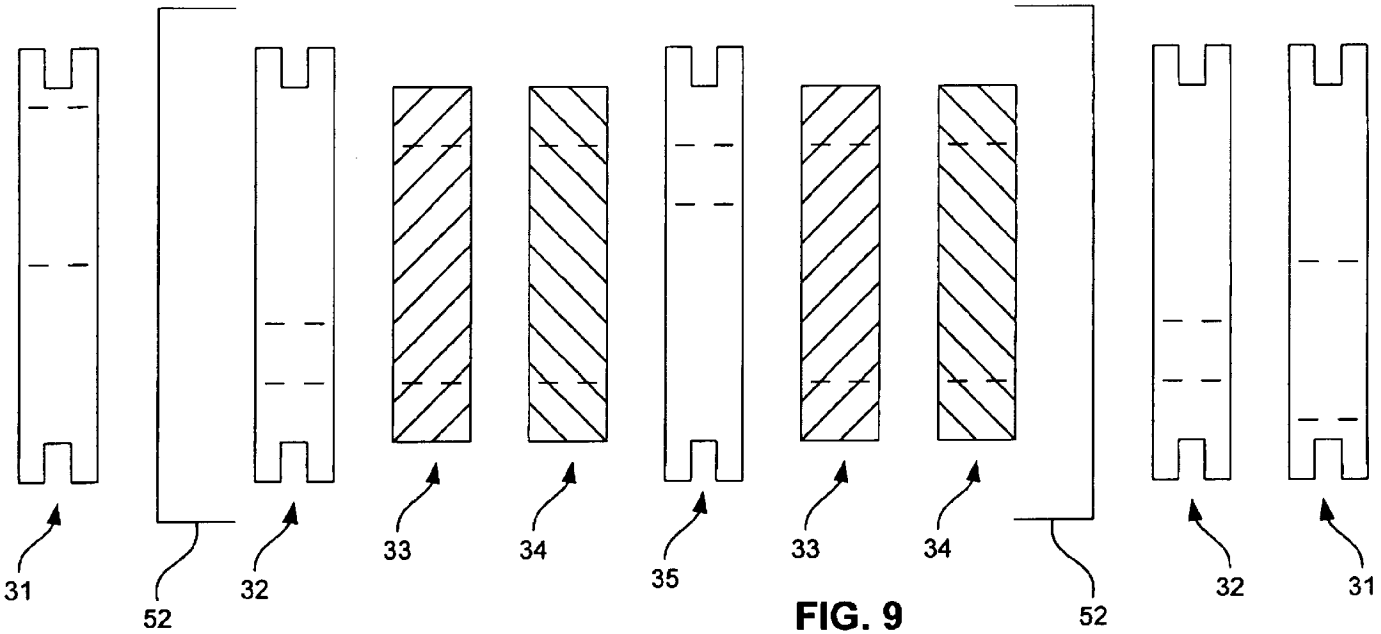
FIG. 9 is a diagrammatic representation of the repetitive pattern of disk placement according to this invention.

The size of the device between the input and output ends can be varied in two directions, lengthwise or cross section wise. If lengthwise, a plurality of segments 51 having the specific plastic and metal disks as shown and as seen between the two brackets, 52, as seen in FIG. 9, are set out in successive order between the two plugs with a minor caveat. Not shown in FIG. 9 are the end disk 30 with a central opening 46C, and the optional disk 36 of FIG. 10. At least the end disk 30 must be used in order to have fluid communication with the input and out plugs whose connections for the flow of fluid are centrally disposed relative to the diameter of the body portion 11. Thus a device according to this invention intended for a Geo™Metro™ might be smaller in extension than would be used for a Hummer®. The typical diameter of a plastic disk is 2⅜ inches while a metal disk is two inches in diameter.

The alternate means of size change is to increase the diameter of the device. Each cell—a cell is defined as the space surrounding a pair of adjacent metal disks between a pair of opposed plastic disks added to the space that is the raceway slot of the pair of metal disks,—can be increased in diameter and can have the size of the raceway slot increased or decreased according to a mode to be set forth infra.

Figure 8:
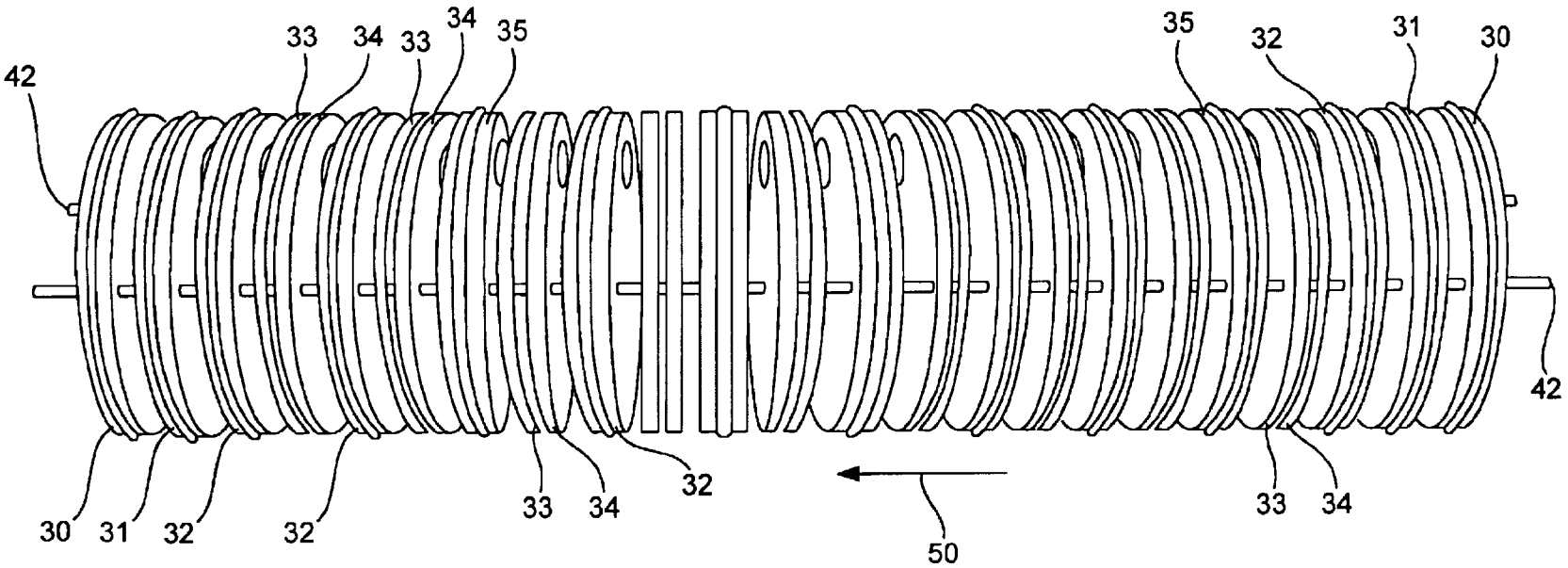
FIG. 8 is a perspective view of the disk alignment in the housing of this invention.

While any number of cell sets can be utilized along the length of the main body portion 11, I have found that the use of nine sets of cells spaced as shown in FIG. 8 with a cubic volume of about 2.49 cubic inches per cell provides the broadest spectrum of utility for passenger cars and trucks. While nine is the ideal number, eight cells and ten cells can also achieve results that are highly beneficial. The reason nine was chosen is that the fluid flow through the passageway with the plastic and metal disks does not transpire at a uniform speed. The fuel, be it gasoline or diesel, speeds up along straightaways and slows down when it makes a right turn. The path of travel, once inside the passageway of the body portion is quasi-sinusoidal: in the middle up to the "top", across the next disk, down, across the "bottom", up and through the cell members, and then through a similar sinusoidal motion again. The use of nine cells allows one to calculate an average speed through the entire device from entry to exit. This is beneficial as fluid flow through the device is not uniform due to the built in changes of direction that are present to increase the tumbling effect upon the fuel.

In order to increase effectiveness of the cell in carrying out the desired goals of reducing emissions and particulates and increasing mpg, the smoother the surfaces of the abutting faces of the adjacent disks, the closer the contact will be of the copper-based disks with each of the zinc-based disks.

The discussion turns now to the body portion and to the two metal disks that form each cell. The body portion material does not contribute to the operation of the device of this invention. Thus such materials including but not limited to stainless steel, cast iron, aluminum, inert plastics such as polyethylene and other polyolefins, and any other materials that are not affected chemically by the presence of gasoline or diesel fuel may be employed for the body portion as well as the end caps. I prefer stainless steel for its strength, availability and machinability.

The zinc disk is not just off the shelf zinc, but is zinc that is at least 99% pure and preferably as high as 99.9 percent pure zinc. The copper disk is in fact formed from a copper alloy of 11% to 20% pure silver and 80 to 89% electrolytic grade copper. Both pure zinc and pure silver are available in the marketplace.

In order to make the alloy of copper and silver, 1,000 grams of copper are measured out. Then the desired percentage by weight of silver is weighed out. It has been found that an ideal percentage of silver for the alloy is 15 percent silver and 85 percent copper. This combination works well for both diesel and gasoline fuels. For devices intended primarily for diesel fuel treatment, the silver content should be reduced to about 12% or so. For devices intended for treatment of very high octane fuel such as 100 octane aircraft fuel, the silver content should be increased close to the 20% portion.

How does one determine the size of a cell for a specific vehicle? The determination is made mathematically. The following EXAMPLE A is an illustration of the procedure to be followed. Let us assume that the vehicle at issue is a Chevrolet® Tahoe® SUV that achieves 10 mpg at 60 miles per hour.

Therefore 60/10 equals 6 miles to one gallon of fuel or to 231 cubic inches of fuel. Thus, six times 231 cu. in=1386 cu. in. of fuel per hour. To determine the amount per minute, divide by 60, such that 1386/60=23.1 cu. in per minute. Dividing again by 60 we find that 0.385 cu. in. of fuel is used per second. I have determined that using a factor of 2 pi times the amount of fuel used per second. Here 0.385 determines the capacity of the cell needed. Here the answer is 2.419 cubic inches of capacity in toto. If, as is suggested, nine cells are found in the device, divide the capacity of 2.419 by 9 to achieve the 0.249 cu. inches per cell capacity needed.

But what is the capacity defined as? It is the volume of space between two adjacent plastic disks when the space there between is occupied by a cell, which is defined as one of each of the metal disks, each with its racetrack slot therein. Thus, to achieve the desired spatial capacity one can alter the thickness of each metal disk, a uniform same amount for each. Or, the raceway slot can be enlarged or made smaller as may be needed to achieve the desired number. Or a combination of both adjustments may be utilized to achieve the desired capacity.

Figure 11:
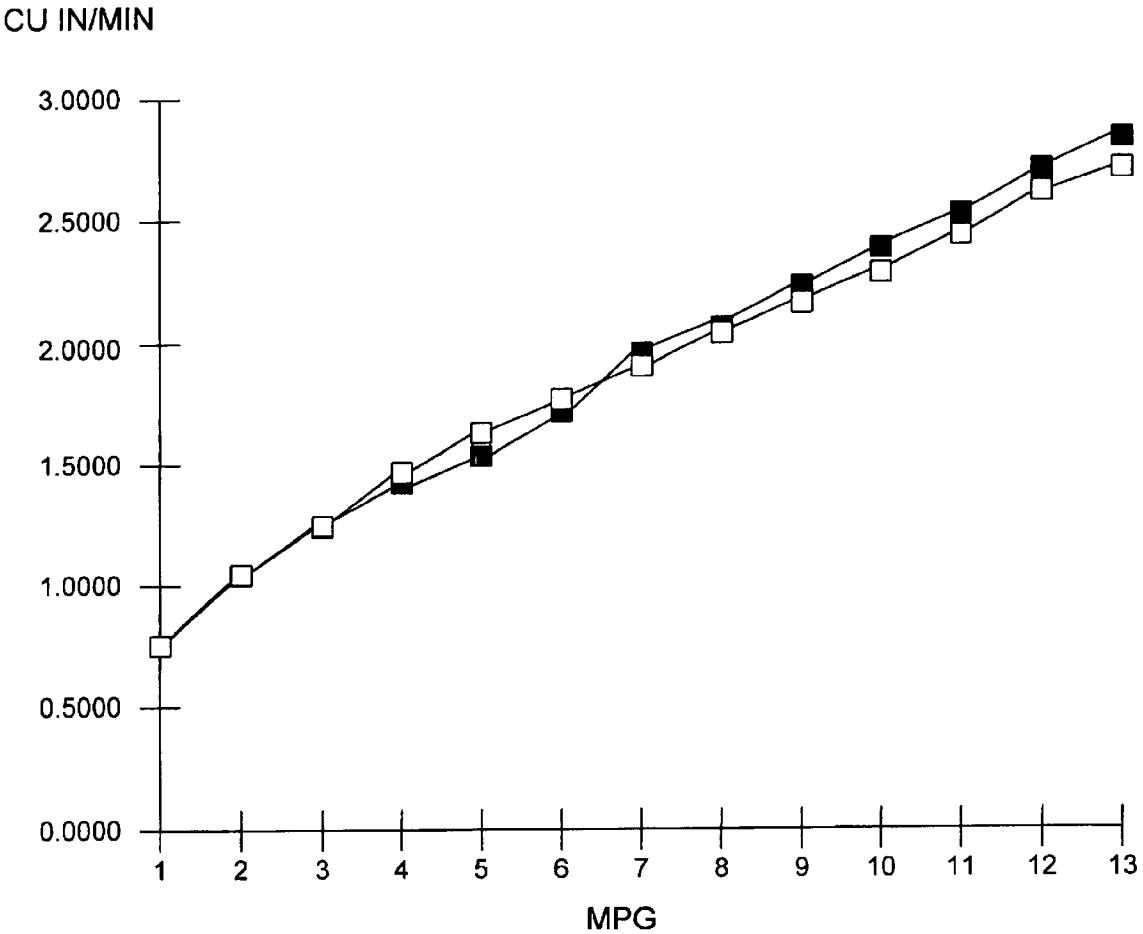
FIG. 11 is a graphic depiction of the contrast of actual versus calculated miles per gallon achieved plotted against cubic inches of fuel utilized per minute.

The relationship between calculations of the use of fuel and the measurement of the use of fuel is illustrated in the graph of FIG. 11. The actual measured results are the dark plot while the calculated anticipated results are the white box plot. The calculations were carried out in accordance with the manner set forth in EXAMPLE A above.

Other cars and trucks will have either greater or lesser fuel consumption as measured in cubic inches per minute. Once determined, the formula recited for determining cell size can be applied and the cell space calculated by doing any of altering the diameter of the body portion, lessening or increasing the diameter of the metallic disks, or changing the dimensions of the raceway of the metallic disks.

Operation Phenomenon

The purpose of the device is to increase the combustibility of the fuel and thus lessen environmentally damaging particulate and gaseous emissions. This device augments the performance of the effectiveness of existing installed pollution controls on vehicles and will not diminish or negatively impact their function.

While not substantiated, it is hypothesized that this device thermally stimulates and electrostatically charges fuel without any modification to the engine, the necessity of an external power supply, chemical additives to the fuel, moving parts or magnets. The stimulation and charging created by the fluid flow path of the device creates an increased "thinning" of the fuel which enables a more complete burn in the engine to transpire.

Each disc has machined pathways that channel the fuel around and through the metal disks and only through the plastic ones due to diameter differences. A "tumbling" effect is believed to be created as the fuel flows from one end of the housing to the other to the ignition site. This "tumbling" effect thins the fuel: increases its effervescence, decrease its natural properties of coagulation and destabilizes its dense, viscous nature.

A quasi-sinusoidal motion is incurred by the flowing fuel. This can be seen by a close inspection of the location of the openings in the series of disks shown in FIG. 4. The term "quasi-sinusoidal" is used because of the wavelike travel of the fluid, up-over-down-over back up etc. through the device from one end to the other.

Test Results

In tests discussed below, a device according to this invention having nine cells and each cell having a capacity of 0.249 cubic inches was employed.

A 2001 Toyota Camry was driven along a predetermined measured course of about 200 miles on streets and freeways in metropolitan Sacramento and measurements made a t a local certified smog station. When a device according to this invention was put on the same 2001 Toyota Camry and driven over the same course at the same speeds for the 200 miles on the same public streets and highways, and then subjected to the same test procedure, the information set forth was found.

It is to be understood that while the initial run was over a predetermined 200(+−) mile course in accordance with California law, a test of the car was made with the device thereon prior to running the course, in order to ensure that a polluting vehicle was not riding on the highway. This test was run after just a few miles, which mileage corresponds to the distance from the inventor's work facility to the smog testing station.

At 15 mph on the smog tester, there was a reduction of 40% of hydrocarbons and 33.3% reduction in the amount of nitrous and nitric oxides from 6 ppm to 4 ppm. At 25 mph on the machine, hydrocarbons were reduced 66.6% and nitrous oxide reduced 100% from 2 ppm to 0 ppm. [ppm= parts per million] compared to the original test of the Camry without the device.

After the second predetermined course traverse—with the device thereon—it was found that at 15 mph the carbon monoxide reading was 0 ppm, a reduction of 100%. The hydrocarbon emissions was also 0 ppm, again a 100% reduction; while the nitrous oxide reduction was 66.6%.

When a second "smog test" was run on the tester at 25 mph, the carbon monoxide and the hydrocarbon results were again 0 ppm and the nitrous oxide was now a 100% reduction, having gone from 2 ppm to 0 ppm.

In another test involving a Chevrolet 2500 V-8 truck with automatic transmission, when driven over the predefined course of 200 miles, and tested. Again, prior to running the predetermined course a confirmation of nonpollution of the vehicle test was run, but those results are not presented as California legal requirement were indeed met.

The driver used the vehicle for normal everyday driving for about a week putting about 450 miles on the odometer. The measured course was then driven and the test was run immediately thereafter at both 15 mph and 25 mph on the smog tester machine.

It was found that at 15 mph in testing the hydrocarbons dropped from 46 ppm to 10 ppm, CO dropped from 0.04 to 0.01 ppm and NO dropped from 14 ppm to 2 ppm. When the test for smog was run at the independently owned test facility at 25 mph, the hydrocarbon content dropped from 36 ppm to 19 ppm. The CO dropped from 0.03 to 0.01 and nitrous oxide dropped from 5 to 2 ppm. These are significant results in the fight against air pollution.

As compared to no device on the Chevy truck, the results of the test for carbon monoxide, hydrocarbons and nitrous oxide at 15 mph and at 25 mph on the test machine is as follows:

| 15 mph | 25 mph |
|---|---|
| carbon reduced by 100% to 0 ppm | same as 15 mph |
| hydrocarbons reduced to 0 ppm | same as 15 mph |
| nitrous oxide reduced to 0 ppm | reduced by 80% to 1 ppm from 5 ppm |

As to a decrease in fuel consumption in the Camry after the installation of this device, it was found that on the 200-mile trip aforementioned prior to the device installation, the Camry averaged 31.29 mpg, and on the run after the installation, it averaged 37.47 mpg [A 19.7% increase in miles per gallon]. For the Chevrolet 2500 HD crew cab pickup, over the same course, pre and post installation, the efficiency went from 14.7 mpg to 18.31 mpg. An increase of 24.56.

Significant increases in mpg and reduction in particulates were also achieved in similar tests run on a class 8 heavy duty diesel engine truck, namely, a 2000 Kenworth with a caterpillar 3406E at 550 hp.

It is seen that I have provided a device that is suitable for both gasoline and diesel fuel vehicles for increasing the efficiency of the engine, i.e. More mpg and for reducing the particulate and noxious gas outputs from these engines.

While rods have been disclosed as the preferred means of keeping the plurality of disks aligned to ensure that the desired fluid flow path is transcended, other means such as but not limited to inwardly extending bosses that engage uniformly placed notches in the disks could also be used to achieve the same desired result The terms in let end and input end are used here interchangeably, as are the terms output end and outlet end used interchangeably.

Since certain changes may be made in the described apparatus without departing from the scope of the invention herein involved, it is intended that all matter contained in the above description and shown in the accompanying drawings shall be interpreted as illustrative and not in a limiting sense.

I claim:

1. A fuel conditioning device designed for interposition between an engine's fuel supply line and the engine's fuel combustion zone, which device comprises a cylindrical body portion, with an input end and an output end, and a flow through passageway in the body portion;

the input end is in fluid communication with the fuel supply line, and the output end is in fluid communication with the fuel combustion portion of the engine;

wherein disposed within the body portion is a series of cells comprised of a pair of plastic spaced and opposed disks with a copper-based disk in intimate contact with a zinc-based disk between each such pair of opposed spaced disks.

2. The device of claim 1 wherein the copper-based disk of each cell face the input end of the device.

3. The device of claim 1 wherein the copper-based disk comprises an alloy of 11 to 20 percent pure silver and 80 to 89 percent electrolytic copper.

4. The device of claim 1 wherein the zinc-based disk is pure zinc.

5. The device of claim 3 wherein the silver percent is 15 percent of the alloy total weight.

6. The device of claim 1 wherein the copper-based disk comprises an alloy of 11 to 20 percent pure silver and 80 to 89 percent electrolytic copper, and both metal disks have the same size centrally disposed racetrack shape cutout.

7. The device of claim 1 including means to retain the disks in a predetermined aligned relationship within the body portion.

8. The device of claim 7 wherein the means to retain disks aligned, comprises a pair of spaced bores through each disk at the same locations, and a respective rod extending through each spaced bore.

9. A fuel conditioning device designed for interposition between an engine's fuel supply line and the engine's fuel combustion zone, which device comprises a flow through body portion, having an input end and an output end, each end having a hollow plug therein, wherein the input end plug is in fluid communication with the fuel supply line, and the output end plug is in fluid communication with the fuel combustion portion of the engine;

and disposed within the body portion is a series of bored, only plastic disks at each end, a first set at the inlet end and a second set at the outlet end, a series of cells comprised of a pair of plastic spaced and opposed disks with a copper-based disk in intimate contact with a zinc-based disk between each such pair of opposed spaced disks, said series being located between the first series of only plastic disks whereby fuel flows through the bored plastic disks and at least around the cells' metal disks and through the second set of bored plastic disks for egress to the combustion area of an engine.

10. The device of claim 9 wherein both metal disks have the same size centrally disposed racetrack shape cutout, and each metal disk is of a diameter smaller than the plastic disks.

11. The device of claim 9 wherein the bores of the first series of only plastic disks provide a quasi-sinusoidal travel path for the fuel to travel on route to the first cell.

12. The device of claim 10 wherein the bores of the first series of only plastic disks provide a quasi-sinusoidal travel path for the fuel to travel on route to the output plug.

13. The device of claim 1 wherein each plastic disk has a centrally disposed edge groove with an O-ring disposed therein.

14. The device of claim 9 including means to retain the disks in a predetermined aligned relationship within the body portion.

15. The device of claim 14 wherein the means to retain disks aligned, comprises a pair of spaced bores through each disk at the same locations, and a respective rod extending through each spaced bore.

16. A fuel conditioning device designed to be positioned between a fuel supply and a fuel combustion portion of an engine which device comprises an elongated tubular housing having an inlet end, an outlet end, and a flow through passage extending there between;

wherein the inlet end is coupled to the fuel supply to receive fuel flow there into the flow through passage, whereby upon a flow of the fuel, the fuel flows upwardly and downwardly through a series of bored plastic and metal disks disposed in said passageway to condition the fuel to increase combustibility and lessen particulate emissions, said metal disks including copper and zinc based disks.

17. The device of claim 16 wherein the metal disks are of a lesser diameter than the plastic disks, and metal disks comprise a copper-based disk and a zinc-based disk in intimate contact therewith.

18. The device of claim 17 wherein both metal disks have the same sized racetrack shape bore therein, and the bores are aligned and the metallic disks are placed with the copper-based disk facing the input end of the device.

19. The device of claim 16 wherein the series of plastic disks impose a quasi-sinusoidal travel path for fuel moving therethrough.

20. The device of claim 16 wherein the bored plastic series of disks on the fuel inlet end of the device preceding the metal disks have spaced rod apertures for alignment of said disks, and wherein the first disk adjacent the end cap has a central opening, the second disk has a half racetrack slot, and the third disk has a circular opening at one end of the disk.

* * * * *